United States Patent [19]

Baars

[11] 3,975,837

[45] Aug. 24, 1976

[54] WALL-MOUNTED NOTICE BOARD

[76] Inventor: Dieter Baars, 25 High St., Glen Ridge, N.J. 07028

[22] Filed: Apr. 16, 1975

[21] Appl. No.: 568,567

[30] Foreign Application Priority Data

Apr. 22, 1974 Germany ..... 2419245

[52] U.S. Cl. ..... 35/63; 49/411

[51] Int. Cl.[2] ..... A47B 97/06

[58] Field of Search ..... 35/60, 62, 63, 65; 312/230; 49/409, 410, 411

[56] References Cited

UNITED STATES PATENTS

| | | | |
|---|---|---|---|
| 849,291 | 4/1907 | Van Slyke | 49/410 X |
| 892,954 | 7/1908 | Hanson | 35/63 |
| 1,881,636 | 10/1932 | Johnson | 35/63 |
| 2,386,510 | 10/1945 | Shafer | 49/409 |
| 2,825,152 | 3/1958 | Baylon | 35/63 |
| 2,945,535 | 7/1960 | Haws | 49/409 X |
| 3,105,272 | 10/1963 | Tucker | 49/411 |
| 3,107,442 | 10/1963 | Levine | 35/63 |
| 3,563,782 | 2/1971 | Liberman | 35/66 X |
| 3,642,562 | 2/1972 | Kawaguchi | 35/66 X |
| 3,659,355 | 5/1972 | Aubin | 35/62 |

*Primary Examiner*—Harland S. Skogquist
*Attorney, Agent, or Firm*—Howard E. Thompson, Jr.

[57] ABSTRACT

A wall-mounted notice board providing multiple access writing and display panels comprising a frame having four peripheral portions joined to a rear wall, a front wall fitting within said frame having pivots at one side and protruding beyond opposed edges thereof engaging movable guides in opposed peripheral portions of the frame enabling the front wal when pivoted outwardly of the frame to be moved from side to side in said frame thereby selectively exposing the inner surface of the rear wall and opposed surfaces of the front wall as accessible writing and display surfaces.

8 Claims, 4 Drawing Figures

WALL-MOUNTED NOTICE BOARD

The invention relates to a wall-mounted notice board, more particularly for use in offices, and aims to solve the problem of providing a versatile notice board which occupies only a small amount of space.

To this end according to the invention, the notice board is disposed to pivot by one outer edge on the frame and to slide in the frame in order to change its sides.

As a result, the notice board can readily be adjusted by a few manipulations using one hand to the appropriate position for using one of its two sides at choice, and moreover the inner surface of the frame can also be used at least partially as a notice board for some similar purpose. Another great advantage is that only one side of the notice board is exposed, while its other side and also the inner surface of the frame are normally locked, so that confidential information or the like cannot readily be seen by unauthorized persons.

School notice boards are of course known which can be adjusted for the use of two sides, the notice board being disposed in a frame to pivot around its horizontal central axis, but this is a construction which takes up a large amount of space and is unsuitable for use in offices, due to the exposed position of both sides of the notice board.

Figure 1:
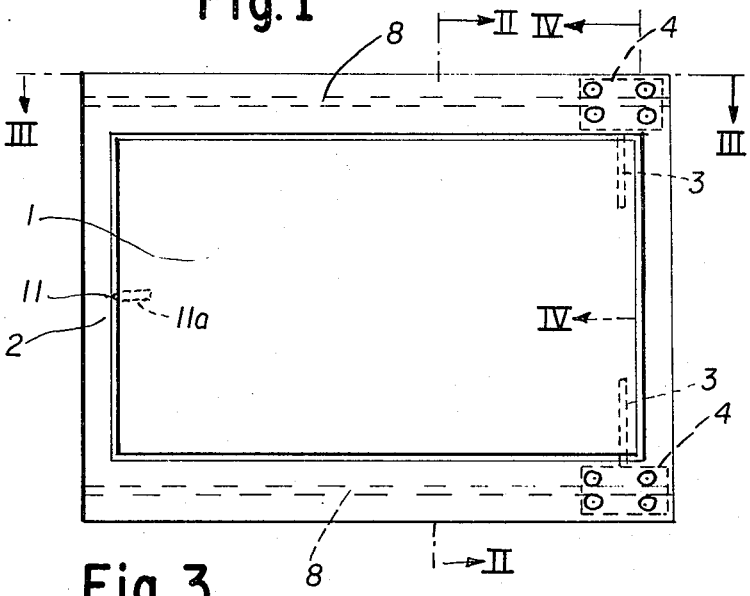
Figure 2:
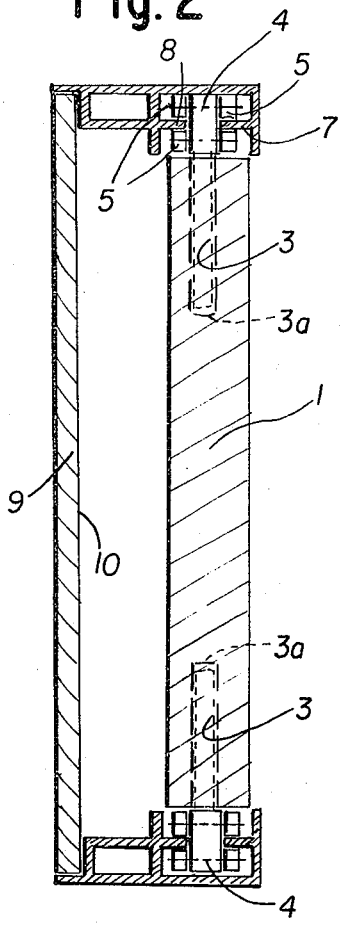
Figure 3:
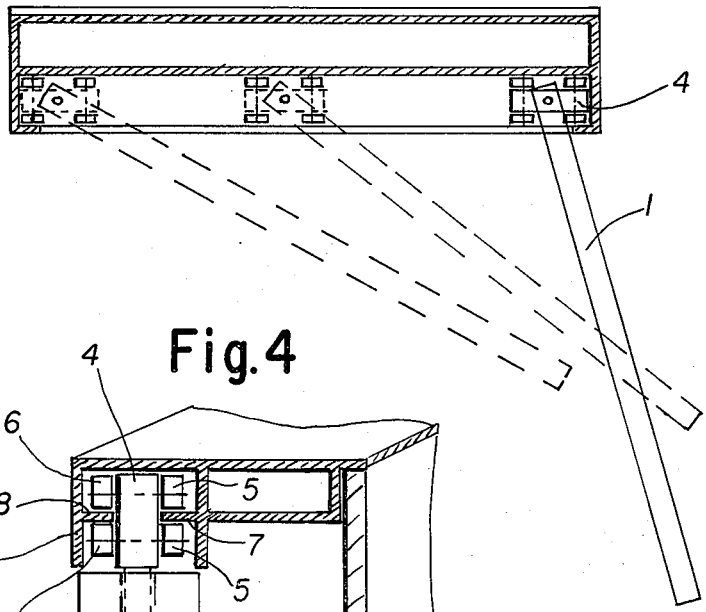
Figure 4:
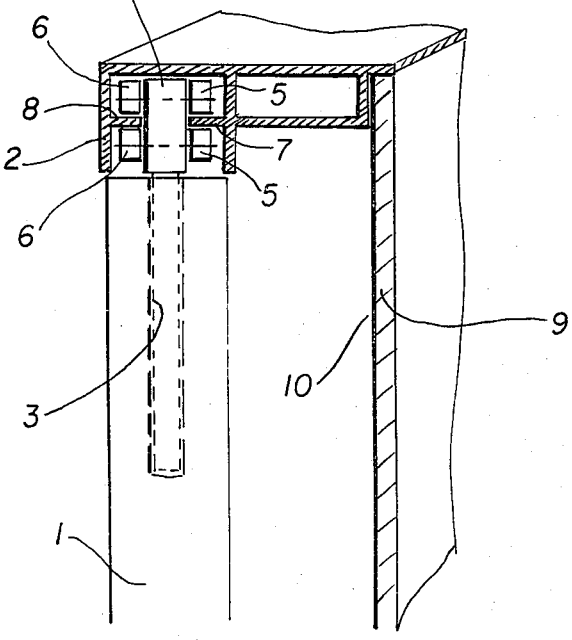

Further features of the invention, set forth in the claims, will be described in greater detail in the following description of an embodiment thereof, with reference to the accompanying drawings, wherein:

FIG. 1 is a front elevation of the wall-mounted notice board according to the invention, FIG. 2 is a cross-section through the wall-mounted notice board, taken along the line II—II in FIG. 1, but to an enlarged scale as compared with FIG. 1, FIG. 3 is a longitudinal section through the wall-mounted notice board, taken along the line III—III in FIG. 1, and FIG. 4 is a partial section through the wall-mounted notice board, taken along the line IV—IV in FIG. 1, but, similarly to FIG. 2, to an enlarged scale as compared with FIG. 1.

As can be seen more particularly in FIG. 1, a notice board 1 is disposed in a frame 2 to pivot adjacent its right-hand vertical edge. For pivoting purposes a bearing pin 3 engaged in a matching bore at the top and bottom of the notice board 1. Each of the bearing pins 3 is attached to a carriage 4 slidably guided in the frame. Each carriage 4 has on both sides two pivotably mounted pairs of rollers 5,6 which, as shown more particularly in FIG. 4, are each slidably guided on guide rails 7,8 connected to the frame 2.

The rear wall 9 of the frame 2 advantageously consists of a rigid sheet of wood, metal, or the like which is attached in suitable manner to the frame 2, which may be fashioned from wood, plastics or metal, but preferably aluminium. The inner wall surface 10 of the sheet 9 can take the form of a writing surface. The wall surface 10 can also be adapted to receive detachable magnetically adhering numerals, letters or other markings.

The notice board 1 can be made, for instance, of a hard plastics foam with lined outer surfaces forming a writing surface. In this embodiment guide bushes 3*a* for the bearing pins 3 are mortised or cast into the hard plastics foam. A strip of wood might be inserted in the corresponding pivoting edge of the notice board for reinforcement purposes and to receive the bearing bushes 3*a*. The notice board surfaces can also be partly or completely adapted to the application of magnetically adhesive markings.

Devices for fixing the notice board in its particular position of use are provided on the notice board 1 and frame 2 as diagrammatically shown at 11, 11*a* in FIG. 1. The fixing devices can also consist of known magnetically adhering devices.

The notice board 1 and the frame 2 may also have a locking device, suitably located at 11, 11*a*, operable by keys or the like, to make comments and annotations written on the inside of the notice board 1 and the inner surface 10 of the rear wall 9 inaccessible to unauthorized persons, even in the absence of the owner of the notice board.

To manipulate the notice board 1, that is to say to change it over from one position of use into the other, after the fixing device 11, 11*a* has been released, the notice board is pivoted from the position shown in FIG. 3 by its left-hand vertical edge out of the frame 2 and brought substantially into the position shown in solid lines. Then, as shown by the two positions indicated in dotted lines in FIG. 3, the notice board 1 is moved by the two carriages 4 to the other side of the frame 2, pivoted by its free end into the frame 2 and fixed by the fixing device. Then the outer second side of the notice board 1 can be used. The notice board 1 is adjusted back to the other position of use accordingly in the same manner — i.e., the right-hand side of the notice board is pivoted out and then moved by the carriages 4 to the right-hand side of the frame 2, pivoted into the frame 2, and fixed by the fixing device in that position of use.

The notice board 1 might also be mounted for pivoting by its top or bottom longitudinal edge on the frame 2, in which case the carriages 4 for adjusting the notice board from one position of use to the other would have to slide vertically in the lateral members of the frame 2.

The notice board 1 according to the invention may also be advantageously used for school and teaching purposes, or in any situation where a plurality of selectively exposed display and writing surfaces may be desirable.

Various changes and modifications in the wall-mounted notice board as herein disclosed may occur to those skilled in the art, and to the extent that such changes and modifications are embraced by the appended claims, it is to be understood that they constitute part of the present invention.

What is claimed is:

1. A wall-mounted notice board comprising a frame having four peripheral portions and a rear wall joining the same adapted for alignment with a wall on which the device is mounted, a front wall loosely fitting within said frame, pivot means adjacent one side edge of said front wall and protruding beyond upper and lower edges of said front wall into guide means in opposed top and bottom frame parts, and said guide means extending longitudinally along said opposed frame parts permitting said pivot means of the front wall to be moved selectively from one side to the other of said frame, each of said guide means comprising opposed coplanar rails having a close front to rear spacing in said frame, said pivot means comprising eight wheeled carriages extending between said rails and having central pivot pins coaxially engaging said front wall, and said eight wheels of each carriage engaging opposed surfaces of the associated rails at opposed sides of said central pivot pin, to thereby provide load bearing stability in the movable support of said front wall.

2. A wall-mounted notice board as defined in claim 1 wherein the inner side of said rear wall is fashioned to provide a writing and display surface.

3. A wall-mounted notice board as defined in claim 1 wherein both surfaces of said front wall are fashioned to provide writing and display surfaces.

4. A wall-mounted notice board as defined in claim 1 wherein the inner side of said rear wall is fashioned to provide a writing and display surface and both surfaces of said front wall are fashioned to provide writing and display surfaces.

5. A wall-mounted notice board as defined in claim 1 wherein the side of said front wall opposed from said pivot means carries means engaging an associated frame part for preventing unintended pivotal movement of said front wall.

6. A wall-mounted notice board as defined in claim 5 wherein said last named means comprises key actuated means for locking the front wall in a predetermined position of adjustment.

7. A wall-mounted notice board as defined in claim 1 wherein said front wall comprises a rigid body of lightweight material having opposed surfaces fashioned to provide writing and display surfaces.

8. A wall-mounted notice board as defined in claim 7 wherein the rigid body of said front wall comprises hard plastic foam.

* * * * *